United States Patent [19]

Vadas

[11] 3,949,791

[45] Apr. 13, 1976

[54] PISTON TYPE LIQUID FILLER VALVE

[75] Inventor: Leslie Vadas, Los Gatos, Calif.

[73] Assignee: FMC Corporation, San Jose, Calif.

[22] Filed: Mar. 31, 1975

[21] Appl. No.: 565,987

[52] U.S. Cl. ..... 141/5; 141/164

[51] Int. Cl.[2] ..... B65B 3/04

[58] Field of Search ..... 141/264, 272, 274, 4, 5, 141/1, 11

[56] References Cited

UNITED STATES PATENTS

| | | | |
|---|---|---|---|
| 2,701,674 | 2/1955 | Christiansen | 141/164 |
| 2,840,121 | 6/1958 | Carruthers | 141/164 |
| 3,779,292 | 12/1973 | Mencacci | 141/11 |
| 3,830,264 | 8/1974 | Billett | 141/1 |
| 3,892,264 | 7/1975 | Held | 141/5 |

*Primary Examiner*—Robert I. Smith

*Attorney, Agent, or Firm*—C. E. Tripp

[57] ABSTRACT

This invention relates to fillers and filler valves for filling open top containers with liquids or liquid bearing materials. The filler valve of the invention is particularly useful for filling containers with carbonated or other gas containing beverages, such as beer or the like. The valve has four major elements comprising a cylinder having a filling port, a foot valve, a piston having a charging port and a plug valve. The valves are piston-type elements and cooperate with cylindrical seating surfaces formed at their respective ports. The foot and plug valves are provided with resilient seals for seating with the aforesaid cylindrical seating surfaces. At the conclusion of the filling operation, the foot valve is raised from its open position into engagement with the plug valve while the latter is sealed with the charging port. The foot valve is then raised to lift the plug valve until the foot valve seals off the filling port while the plug valve remains seated. This traps gas at atmospheric pressure between the seals. The foot valve is raised an additional amount until the plug valve breaks its seal with the charging port of the piston while the seal between the foot valve and the cylinder filling port is maintained. Thus, the gas that was trapped at atmospheric pressure is readily displaced as liquid from the measuring chamber flows down into the space between the seals. In order to enlarge the measuring chamber slightly, when it is filled with carbonated beverage, to bring the pressure in the chamber to substantially atmospheric pressure, the foot valve is lowered slightly along its cylindrical seat, thereby reducing the pressure in the measuring chamber before initiation of a filling operation.

11 Claims, 18 Drawing Figures

FIG_14
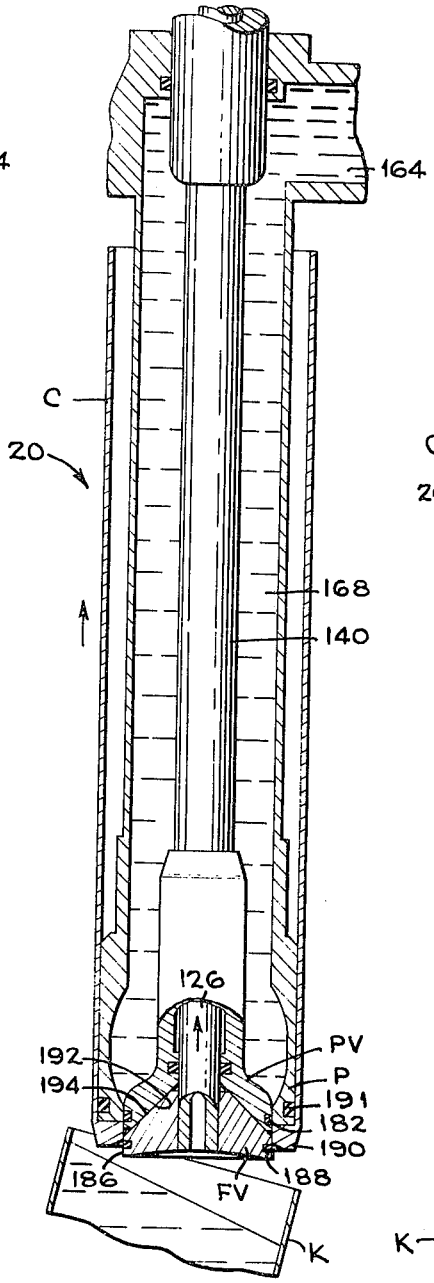
FIG_15
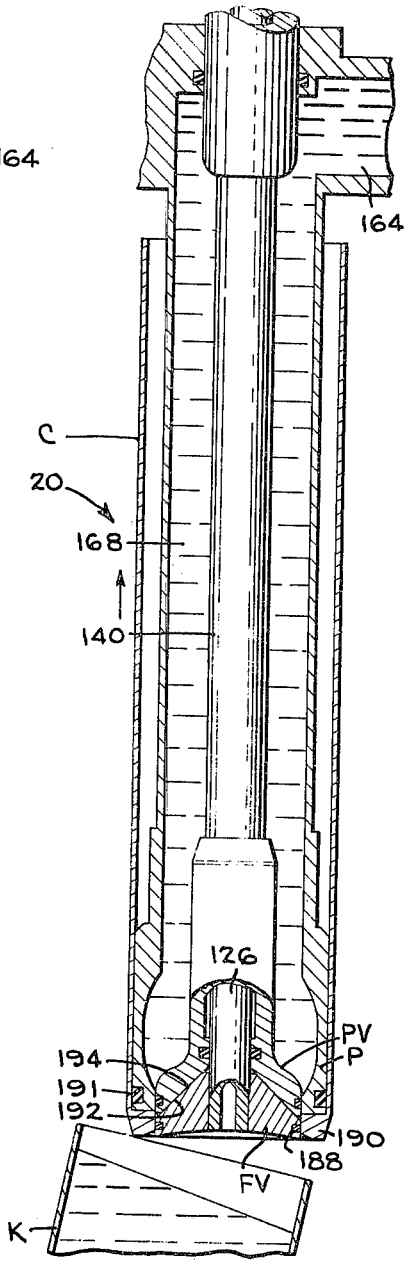
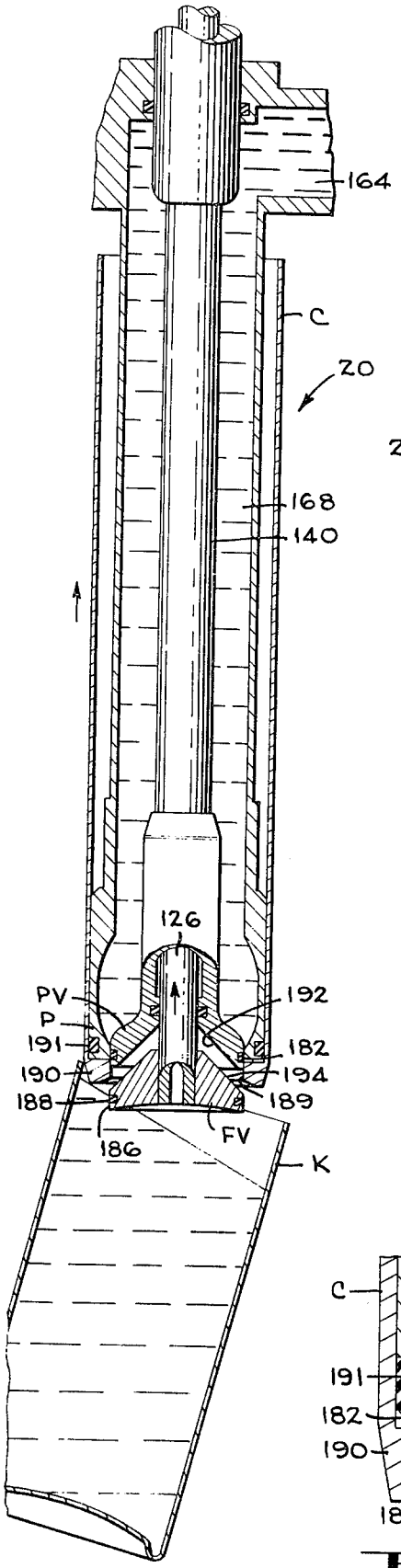
FIG_13
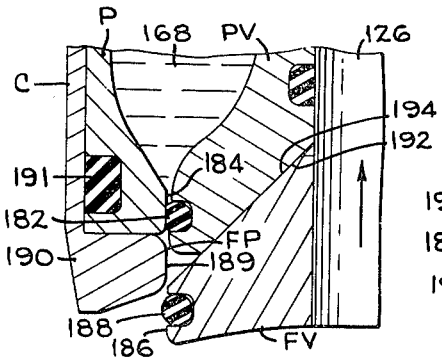
FIG_14A
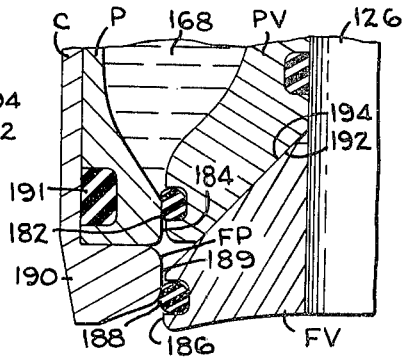
FIG_15A

PISTON TYPE LIQUID FILLER VALVE

DESCRIPTION OF PRIOR ART

The filler of this invention is an improvement over the U.S. Pat. to Mencacci, No. 3,779,292, patented Dec. 18, 1973 and assigned to the FMC Corporation. The filler valve of the aforesaid Mencacci patent includes four major elements, namely a cylinder formed for connection to a liquid reservoir, a foot valve for closing off a filler port in the cylinder, a measuring piston slidable within the cylinder, and a plug valve for closing off a charging port in the measuring piston. The aforesaid elements are independently operated by cam structure, for trapping a measured quantity of liquid in a chamber defined by the elements, followed by opening of the foot valve and displacement of the liquid from the measuring chamber into a container.

Cooperating filling port and foot valve seats and cooperating piston and plug valve seats lie in a cone which opens upwardly. When these valve elements are closed, and when all of the aforesaid elements are brought together (as occurs at the end of a filling operation), air or gas is trapped and compressed between the elements. As a result, when the elements are separated (as occurs during the charging operation for the measuring chamber) this compressed gas escapes into the liquid in the cylinder, causes bubbling and foaming and may dislodge seals between the plug valve and piston elements.

The filler of the aforesaid Mencacci patent provides means for slightly enlarging the measuring chamber, after a charge of liquid has been trapped therein by the various elements, in order to bring the pressure within the chamber down to atmospheric pressure. This is accomplished by moving both the cylinder and the foot valve elements relative to the piston and the plug valve elements while both valves are closed. Because of the conical nature of the seats at the foot valve, the latter cannot move downwardly without a corresponding motion of the cylinder, and hence both of the latter elements must be moved to effect the aforesaid decompression operation.

SUMMARY OF THE INVENTION

The piston type filler valve of the present invention has elements corresponding to those of the aforesaid patent, namely a cylinder, a foot valve, a piston and a plug valve. The filler also embodies cam structure for independently operating these elements, as in the aforesaid Mencacci patent. However, in the filler of the present invention, one of the cooperating seating surfaces between the foot valve and the filling port of the cylinder is cylindrical and sealing means are disposed at the other surface. A similar construction is provided for the plug valve and the seating surface of the charging port in the piston. This construction has several advantages, one of which is that the use of cylindrical, or piston type seating surfaces provides a self-aligning structure and reduces eccentricity problems due to machining operations. Where conical valve seat surfaces are provided, and since the valve elements are mechanically guided, slight eccentricity between the conical seating surfaces and the guiding surfaces can be troublesome. Cylindrical guiding surfaces, operating against resilient seals in the cooperating surfaces of the elements will seal, even if there is some mechanical mis-alignment. In the preferred construction the cylindrical seating surfaces are formed at the filling port in the cylinder and at the charging port in the piston and the seals are provided on the foot valve and on the plug valve.

Another feature of the present invention relates to the problems of trapping gas between the elements at the end of a filling operation, when all of the elements are in juxtaposition. In accordance with the present invention, after completion of a filling operation and with the piston and its plug valve lowered to the bottom of the cylinder, the foot valve is raised from its lowered, open position against the plug valve, to exclude gas from between these valves while the plug valve is sealed with the piston and while the foot valve is open. Thus, when the valves meet the space between the seals is open to atmosphere. The foot valve and plug valve are then raised to seal the foot valve with the filling port in the cylinder while the plug valve remains sealed with the charging port in the piston. This traps gas at atmospheric pressure between seals. In the preferred form of the invention, the two valves are then raised a short distance to break the seal between the plug valve and the charging port in the piston. This permits liquid in the measuring chamber to flow down between the valves and their ports to the seal at the foot valve. Since the small amount of gas trapped in the sealing zone was at atmospheric pressure, the resultant displacement of this gas does not cause foaming in the liquid, and does not blow out seals. As in the Mencacci patent, when carbonated beverages are provided the volume of the measuring chamber is increased slightly just before filling is initiated to reduce the pressure in that chamber. Under the present invention, since the foot valve cooperates with the cylindrical seating surface of the filling port of the cylinder (in the preferred embodiment), such an increase in volume of the measuring chamber is readily accomplished by a slight lowering of the foot valve relative to the cylinder, while maintaining the seal between the foot valve and the cylinder.

Another feature of the invention relates to accurately trapping a measured quantity of liquid in the measuring chamber of the valve. In the valve of the present invention, the plug valve and the cooperating charging port in the piston include cylindrical surfaces so that the plug valve can slide relative to the piston while maintaining a seal. The plug valve is spring lowered against a stop. After liquid has been introduced into the measuring chamber through the open plug valve, the plug valve is spring lowered towards the stop. However, the plug valve first makes seating contact with the seating surface on the charging port on the piston before it has reached its stop, and at this time a quantity of liquid is trapped and compressed in the measuring chamber. The resultant hydraulic block would prevent further lowering of the plug valve, under the force of the spring, against the stop. However, the valve operating means of the present invention lowers the foot valve. This increases the volume of the measuring chamber accordingly, with which the plug valve is no longer hydraulically blocked and it can be lowered by its spring until the plug valve strikes the stop. At this time an accurately measured quantity of liquid is trapped and compressed in the measuring chamber. In order to perform the decompression action on the trapped quantity of liquid, the foot valve (being a piston type valve), is lowered a slight additional amount, thereby increasing the volume of the measuring chamber and reducing the gas pressure therein substantially down to atmospheric pressure.

A 60 valve rotary filler equipped with valves operating in accordance with the present invention, is capable of accurately and dependably filling 1500 cans of beer (for example) in one minute in a commercial installation.

BRIEF DESCRIPTION OF THE DRAWINGS

FIGS. 3 and 4 illustrate one complete filling valve.

FIGS. 7–15 are diagrammatic operational sections showing successive operating conditions of the filling valve during a container filling cycle.

FIGS. 7A, 14A and 15A respectively appearing below FIGS. 7, 13 and 15, are enlarged half sections of the filling valve sealing surfaces which appear in their companion FIGS.

DESCRIPTION OF THE PREFERRED EMBODIMENT

Figure 1:
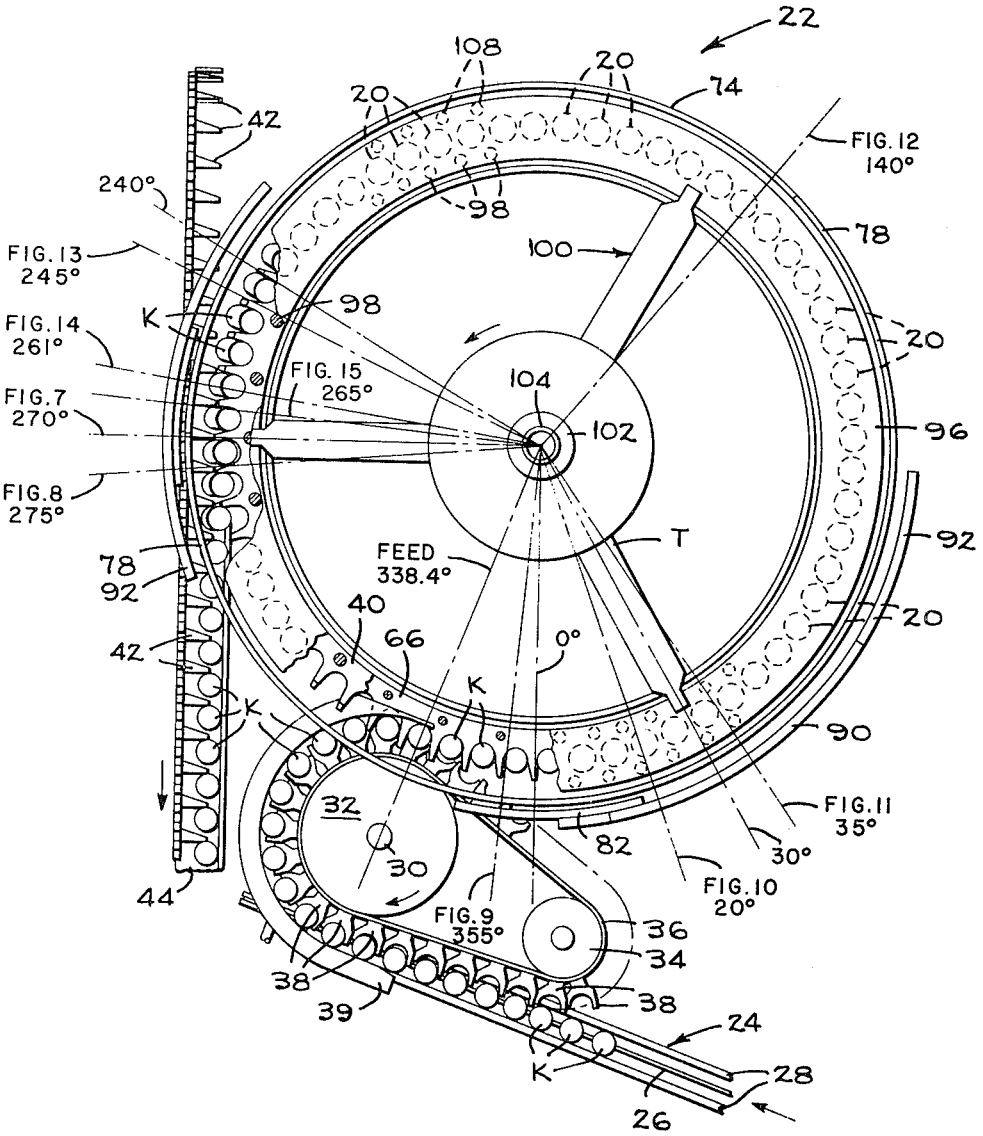
FIG. 1 is a diagrammatic plan, partly broken away, showing the rotary filling machine incorporating the improved filling valves according to the present invention.
Figure 4:
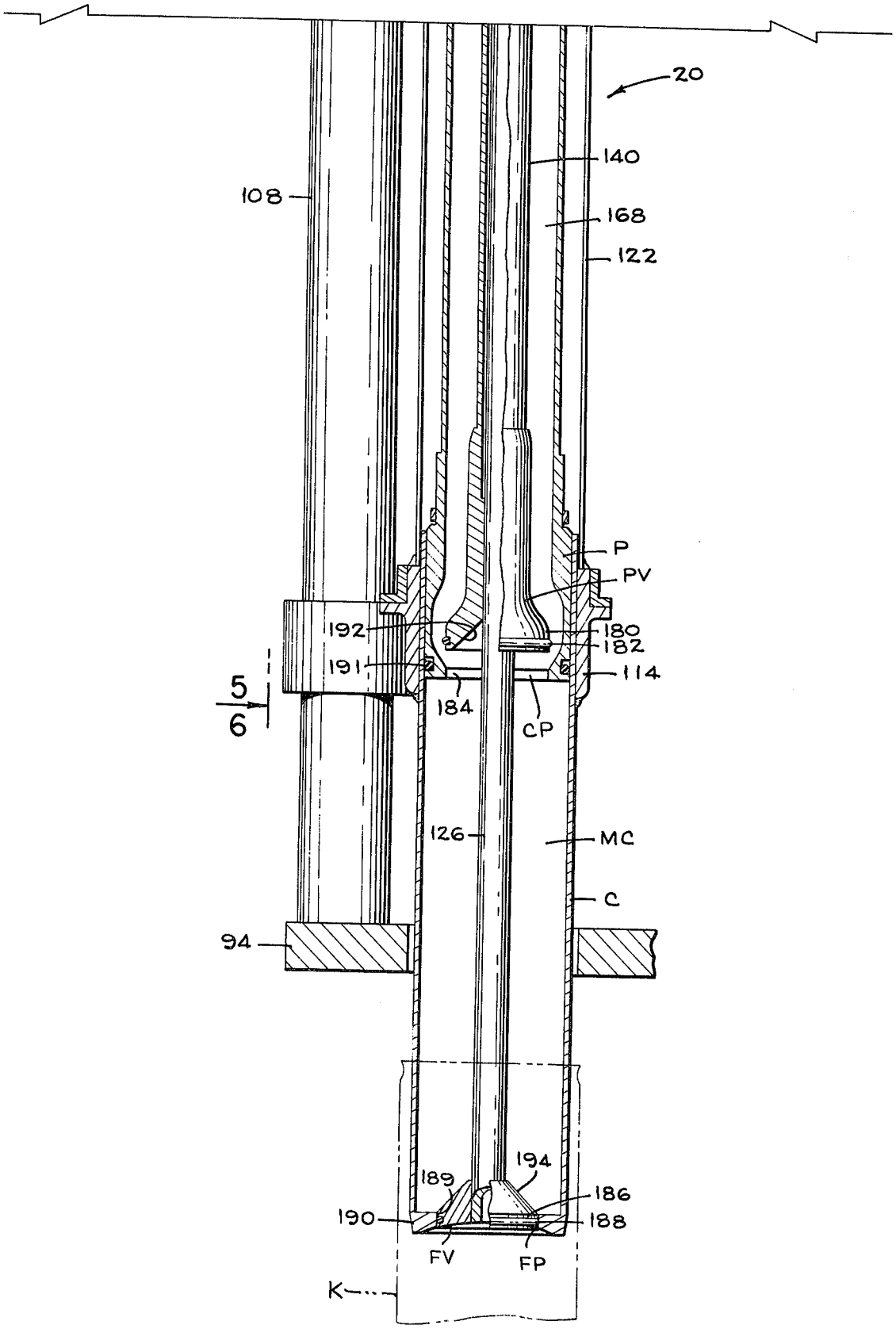
FIG. 4 is an enlarged vertical section of the lower portion of the filling valve shown in FIG. 3, the combined

With reference to FIG. 1, the improved filling valves 20 of the present invention are incorporated in a rotary beverage filling machine 22 for filling carbonated beverage to open top containers K. As seen in FIG. 4, each filling valve includes a cylinder C that telescopes within the containers, a foot valve FV that closes off a filler port in the cylinder, a combined measuring and displacer piston P in the cylinder C and an inlet or valve PV that closes off a charging port in the piston P. Referring back to FIG. 1, the containers are supplied to the filling machine 22 by a feed mechanism 24 which includes a driven container or can support cable 26 flanked by skid rails 28. A power input shaft 30 drives a circular drum 32 which, in conjunction with a second drum 34, carries a flexible belt 36. Mounted on the belt 36 is an endless series of container grippers 38 that carry the cans K, guided by upper and lower rails 39 (FIG. 2), along an arcuate path which becomes tangent with the circular path of the filling valves 20. As the cans approach that point of tangency, they individually seat within pockets in a serrated drive plate 40, that advances counterclockwise as viewed in FIG. 1, and is part of a driven rotary turret T.

Arbitrarily dividing the circumference of the turret into degrees, with 0° at bottom dead center, the cans K are transferred to the turret at 338.4°, each can being aligned below a filling valve. After progressing to about 30°, the filling charge begins to enter the can. The filling operation continues until about 240°, at which time the filling valve 20 closes. The filling valve clears the container at about 270°, where the filled can is positioned between adjacent pusher fingers 42 on a discharge conveyor 44 for transfer to a capping machine, not shown.

Figure 2:
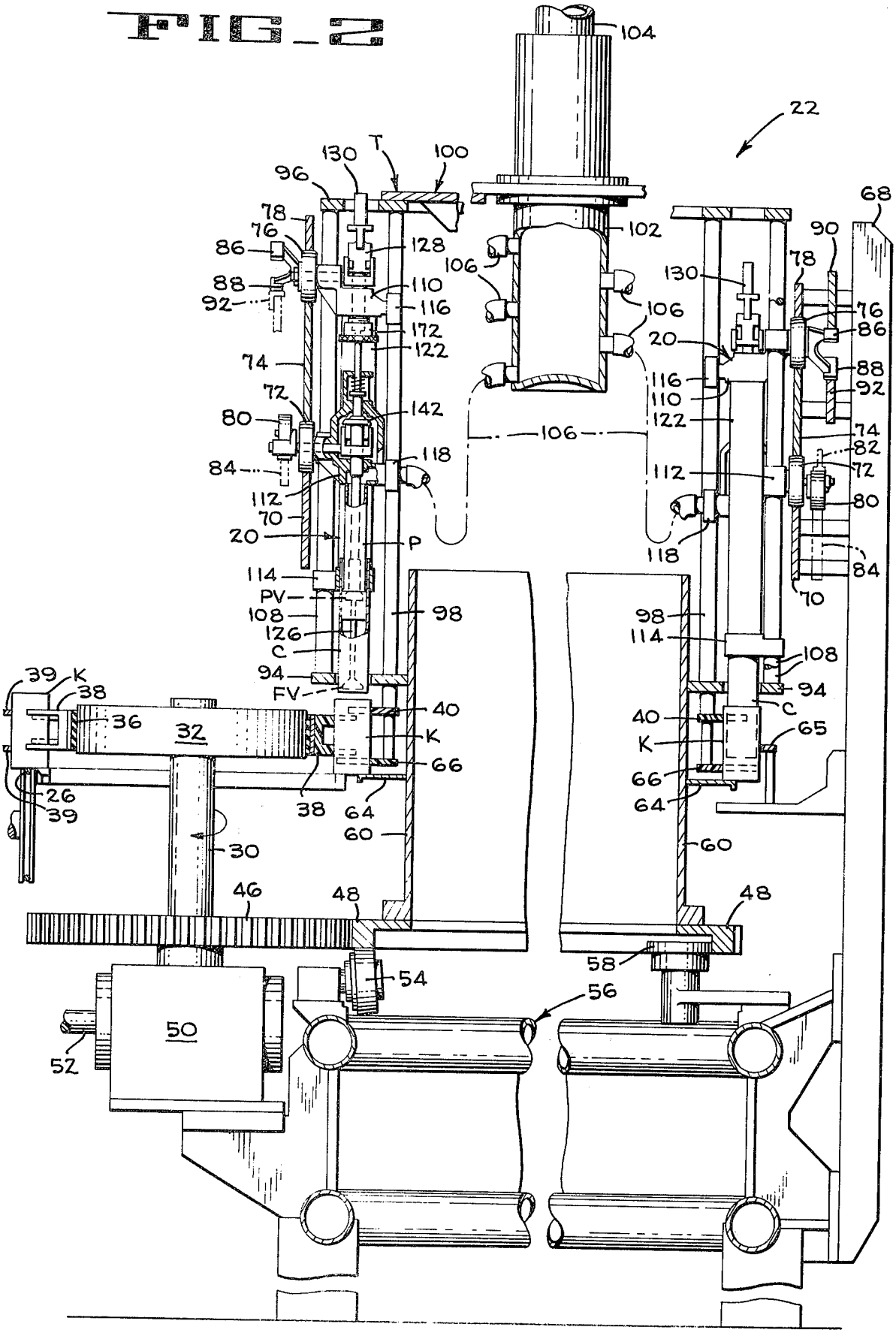
FIG. 2 is a diagrammatic vertical section, the central portion of which is broken away, of the filling machine shown in FIG. 1.

With reference to FIG. 2, the drive shaft 30 carries a gear 46 which is in meshed engagement with a large diameter ring gear 48. Ring gear 46 is powered by a gear box 50 that is driven by a power input shaft 52 from a power source, not shown. The large ring gear 48 directly supports all of the rotatable components of the turret T, and in turn is supported by a plurality of rollers 54 (only one of which is shown) which are mounted atop a fabricated, floor supported frame structure 56. The lateral position of the rotating ring gear 48 is maintained by a plurality of rollers 58 that are rotatable about vertical axes and are engaged with the inner surface of the ring gear 48. Concentrically mounted on top of the ring gear 48 is a hollow rotatable frame 60.

Incoming cans K are transferred from the driven cable 26 onto a semicircular table 62 which has an upper surface coplanar with a lateral flange 64 on the rotatable frame 60. Thus, once the containers are transferred onto the turret T, the container supporting flange 64 and a cooperating lateral guide bar 65 (at the right side of FIG. 2) plus the drive plate 40 and a similar drive plate 66 therebelow, support, guide and propel the containers about the rotational axis of the turret T.

As thus far described, the filling machine 22 is of known construction and general operating principles; the present invention particularly concerns the filling valves 20, and their mode of operation, by means of which gas, air, or liquid is prevented from being trapped or compressed between the sealing surfaces, the flow through the valves is substantially pressure-balanced and free of turbulence, and the sealing elements maintain alignment for effective sealing over a relatively long period of time. Further, the valves and valve actuating mechanisms do not require extremely close manufacturing tolerances for uniform operation among a plurality of valves. A particular structural feature is that the foot valve FV (FIG. 4) which controls the filling port FP, also controls the plug valve PV that opens and closes the volumetric measuring chamber, in which each can charge is collected, to prevent the compression of gas, air or liquid between the sealing surfaces.

A vertical upright 68 at the right margin of FIG. 2 (only one being shown) is typical of several such support members extending around the turret T for supporting a plurality of fixed cam tracks, which actuate the filling valves 20. As later mentioned in more detail, the lowermost and innermost of the cams is a circumferentially continuous piston cam 70. Each filling valve 20 is provided with a piston actuating roller 72, later described, that rides atop the piston cam 70 and beneath a continuous cylinder cam 74. Riding on the upper surface of the cylinder cam 74 is a cylinder actuating roller 76, also a part of the filling valve 20, which, during part of its circumferential travel about the turret T, rides under a cylinder hold down cam 78.

Radially outward of the cams 70, 74 and 78 (refer to the righthand section of the turret T in FIG. 2) each filling valve is provided with a plug valve roller 80 which during part of its travel around the turret T travels under a plug valve closing cam 82. In another portion of its circumferential travel, the plug valve roller 80 (see the left side of FIG. 2) rides over a plug valve opening cam 84. Above the cams 82 and 84, and in another circumferential area of the turret, laterally projecting camming shoes 86 and 88 of each filling valve 20 are respectively actuated by a foot valve opening cam 90 and a foot valve closing cam 92.

Structure for supporting the filling valves 20 (FIG. 2) of the present invention includes a lower ring 94 which is secured to the rotatable frame 60, and an upper ring 96 which is interconnected with the lower ring by a circumferential series of vertical guide rods 98. As shown in FIG. 1, the upper ring 96 supports a spider 100. Centrally mounted in the spider and coaxial with the turning axis of the turret T is a rotatable manifold tank 102 connected to a fixed supply line 104 (FIG. 2) at its upper end. The supply line 104 delivers a carbonated beverage into the manifold tank 102 at superatmospheric pressure, and the beverage is fed to the valves 20 by individual flexible supply lines 106. Also interconnecting the upper and lower rings 96 and 94 of the turret T, radially outward of the guided rods 98, are a plurality of tie rods 108 supply sliding support for each filling valve. Thus, as shown in FIG. 2, each filling valve 20 includes three vertically separated brackets 110, 112 and 114 which are apertured to embrace a single tie rod 108, and the same valve is provided with inwardly directed guide blocks 116 and 118 that are respectively carried by the brackets 110 and 112. The guide blocks 116 and 118 are laterally straddled by two of the previously mentioned guide rods 98 to confine the valve to vertical sliding movement in a radial plane of the turret T.

THE FILLING VALVE 20

Figure 3:
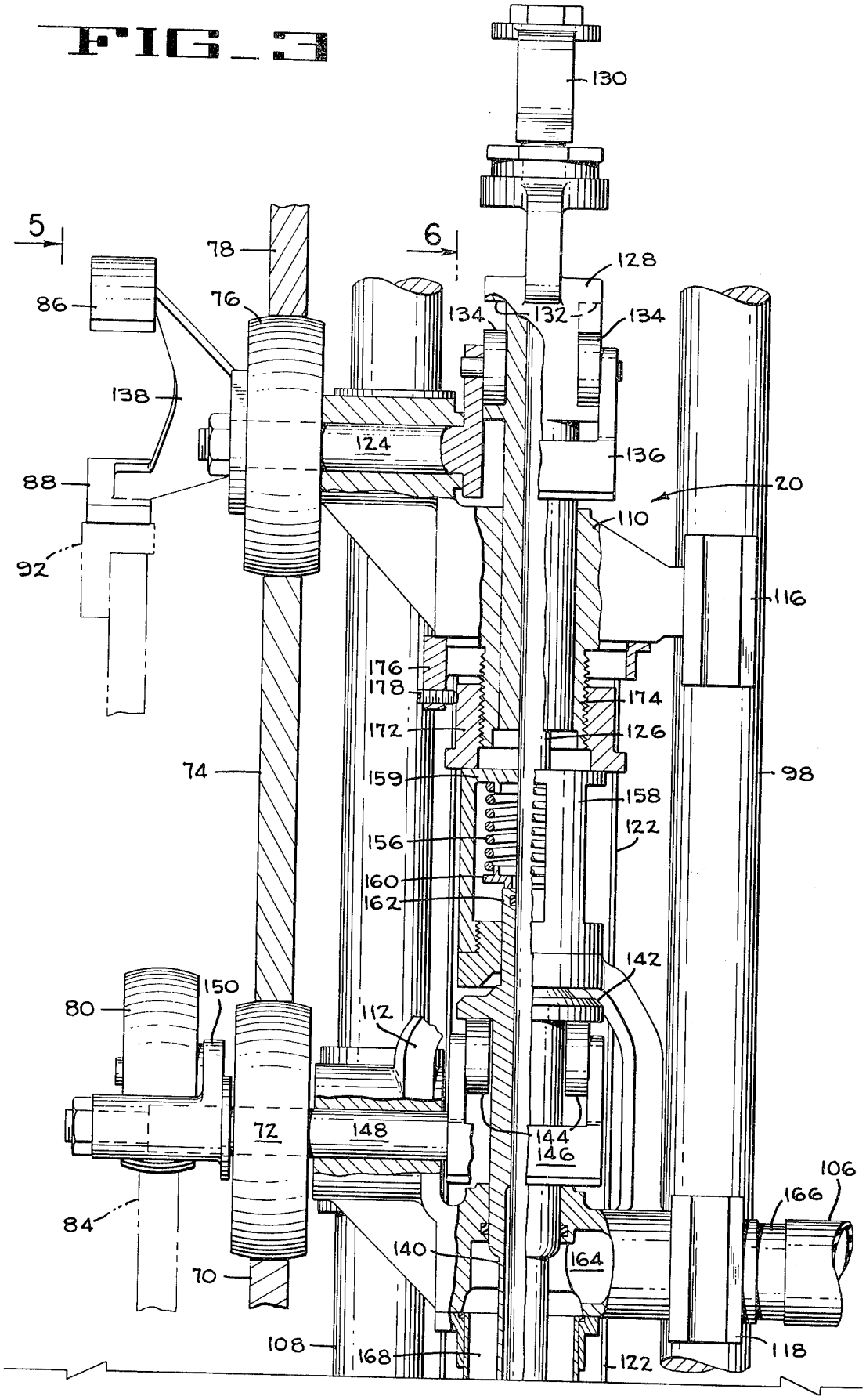
FIG. 3 is an enlarged vertical section, partly in elevation, showing the upper portion of one of the filling valves illustrated in FIG. 2.
Figure 5:
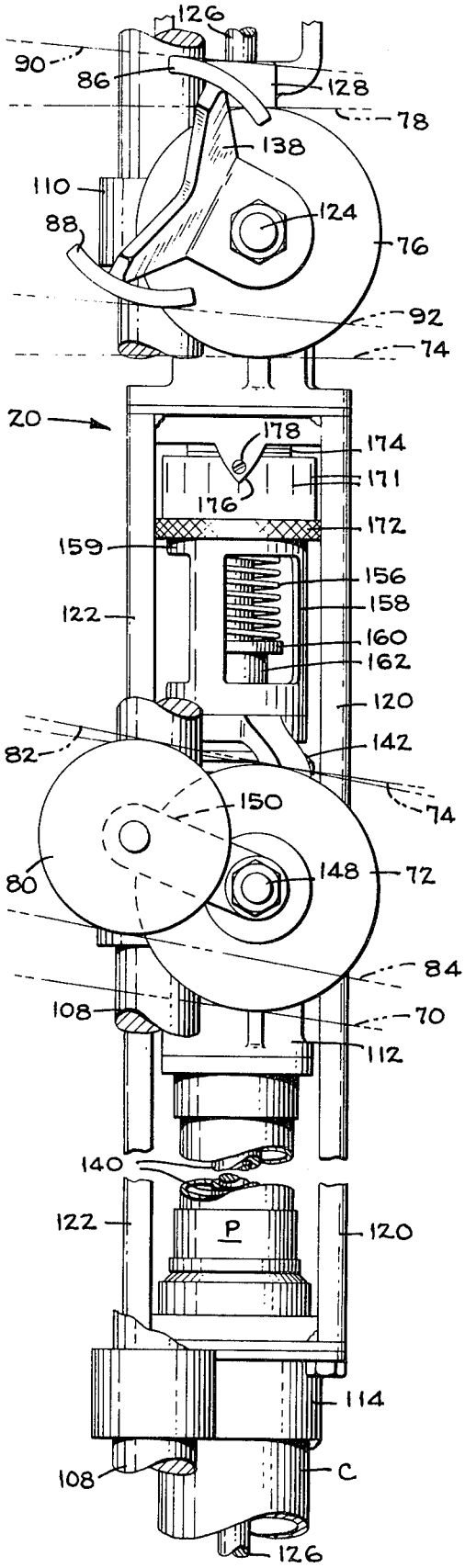
FIG. 5 is an elevation, partly broken away and at a slightly reduced scale, indicated by the section lines 5—5 appearing on FIGS. 3 and 4.
Figure 6:
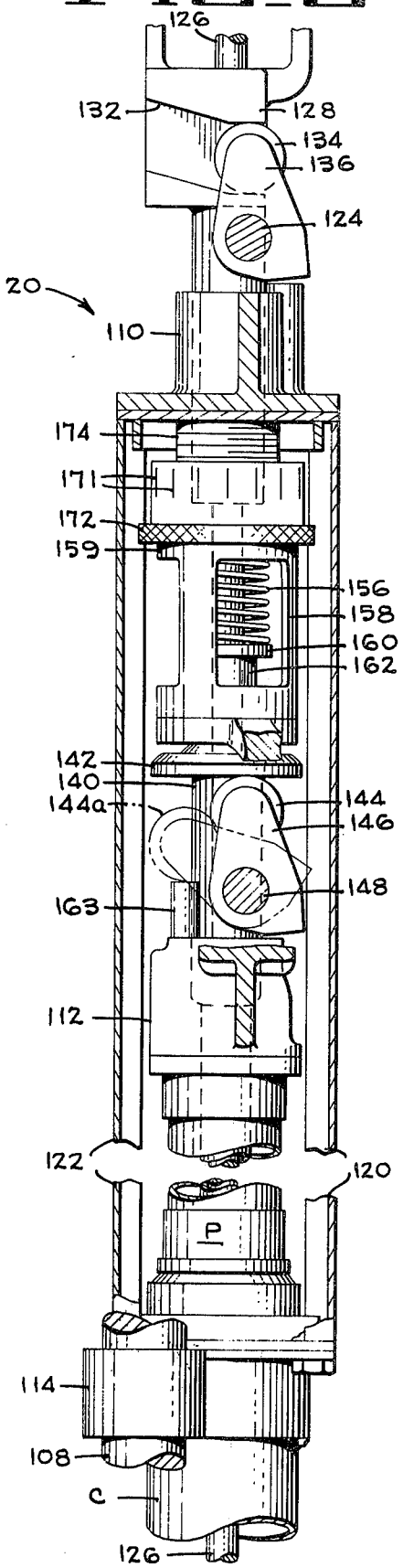
FIG. 6 is a diagrammatic section, at slightly reduced scale, indicated by the section lines 6—6 on FIGS. 3 and 4.

In addition to the internal components of the filling valve 20 being vertically movable relative to one another (plug valve PV, measuring piston P, cylinder C, and foot valve FV) the filling valve 20 is unitarily reciprocable in a vertical direction by means of the previously mentioned cylinder actuating roller 76 (FIG. 3). As best seen in FIGS. 5 and 6, the upper valve bracket 110 is connected to the lowermost valve bracket 114 by laterally spaced channels 120 and 122 which respectively lead and trail the valve as the valve travels about the axis of the turret T. With reference to FIGS. 3–6, the lower portion of the upper valve bracket 110 is welded to the channels 120 and 122, and the roller 76 is mounted on a stub shaft 124 (FIG. 3) which is carried with the bracket 110. Thus, up and down movement of the roller 76 as it traverses the gap between the cylinder cam 74 and the cylinder hold down cam 78 raises and lowers the channels 120 and 122 (FIG. 4) which have their lower end portions welded to the lower bracket 114. As a result, up and down movement of the cylinder actuating roller 76 results in unitary up and down movement of the entire filling valve 20. The cylinder C (FIG. 4) is rigidly connected at its upper end portion to the lower bracket 114 and thus moves up and down with the filling valve unit as described, in order to insert the cylinder into a can K for the filling operation and to retract the cylinder clear of the can after the filling operation is complete.

THE FOOT VALVE FV

The foot valve FV is actuated by an actuating rod 126 which forms the innermost member of the valve assembly and extends upward through the uppermost bracket 110, through a cam track block 128, and is anchored for endwise adjustable movement in an anchor yoke 130 (FIG. 3) that is secured to the cam track block 128. The cam track block 128 is provided with opposed cam tracks 132 (FIGS. 3 and 6) which are engaged by rollers 134 carried by a fork 136; the shaft 124 carrying the cylinder actuating roller 76 is integrally formed with the fork 136. Keyed on the outer end portion of the shaft 124 is an L-shaped arm 138 (see FIG. 5) which is integrally formed with the camming shoes 86 and 88. When the camming shoes 86 and 88 are respectively actuated by the foot valve opening cam 90 (FIGS. 1 and 2) and 92, the shaft 124 (FIG. 3) rocks back and forth to move the rollers 134 in the cam tracks 132.

It will be seen that counterclockwise movement of the fork 136 (FIG. 6) about the axis of the shaft 124 will cause the cam track block 128 to move downward. Since the anchor yoke 130 is integrally attached to the cam track block 128, the foot valve actuating rod 126 is positively actuated to lower the foot valve FV (FIG. 4).

THE PLUG VALVE PV

The plug valve PV (FIG. 4) is cammed open and spring closed to control the charging port CP at the bottom of the measuring piston P in the following manner. The plug valve has an integral hollow shank 140 which is slidable on the actuating rod 126 for the foot valve FV, and which has a terminal upper end portion including a circular flange 142 (FIG. 3). The flange 142 overlies a pair of rollers 144 that are carried by a fork 146 which is similar to the previously described fork 136. An integral part of the fork 146 is a shaft 148 which extends through the bracket 112 and carries both the piston roller 72 and, on its outer end portion, a trailing arm 150, best shown in FIG. 5. A roller 80 on the end portion of the arm 150 is intermittently contacted by the plug valve closing cam 82 and the plug valve opening cam 84 (FIGS. 1 and 3).

Comparing FIGS. 5 and 6, it will be seen that when the roller 80 is raised by the plug valve opening cam 84, the fork 146 erects the rollers 144 into approximate vertical alignment with the shaft 148, thus raising the flange 142 of the plug valve actuating mechanism. Conversely, when the rollers 144 are moved downward to the phantom line position **144*a* as the plug valve closing cam 82 depresses the roller 80, the plug valve flange 142 is allowed to lower under the force of a compression spring 156 (see also FIG. 3) which closes the plug valve and is located just above the flange 142. The spring 156 is contained within a tubular spring cage 158 which is secured to the upper portion of the bracket 112, and is compressed between the upper wall 159 of the spring cage and a spring retainer 160 which rests upon an upward tublar extension 162 of the plug valve operating flange 142. For later reference, it should be noted here that when the roller 144 is in the phantom line position 144*a*, the roller rests on a stop lug 163 on the bracket 112, and is spaced from the valve flange 142. Under a later described operating condition, the flange 142 will contact the roller 144*a*** when a filling charge for a can is decompressed to atmospheric pressure.

The tubular measuring piston P (FIG. 3) depends from and is rigidly secured to the bracket 112 which is moved up and down by the cam roller 72 and the piston cam 70. The upper end portion of the measuring piston P merges with an inlet chamber 164 that is formed in bracket 112 and leads through the guide block 118 to an inlet conduit 166 that is connected to the supply hose 106. Thus, the annular space between the hollow shank 140 of the plug valve PV and the interior surface of the measuring piston P forms a chamber 168 which is continuously supplied with the carbonated beverage from the manifold tank 102 (FIG. 2). When the bracket 112 (FIG. 3) is vertically raised or lowered by the cylinder cam 74 and the piston cam 70, it will be apparent that the lower end of the measuring piston P (FIG. 4) will be vertically adjusted relative to the valve cylinder C, but that the plug valve PV and the measuring piston P move together.

As thus far described, it is believed evident that the upper valve bracket 110 directly supports the entire valve assembly for movement of the valve cylinder C (FIG. 4) into and out of the containers K to be filled. The central bracket 112 is operatively associated with the plug valve PV and the measuring piston P, and the latter are vertically movable with the bracket 112, independent of the overall valve assembly, up and down on the foot valve actuating rod 126. The lowermost bracket 114 directly supports the valve cylinder C and moves up and down with the uppermost bracket 110 because of the interconnecting channels 120 and 122 between the brackets 110 and 114.

VOLUME ADJUSTMENT

In order to adjust the volumetric capacity of the measuring chamber MC (FIG. 4) inside the cylinder C below the plug valve PV and the measuring piston P, the vertical extent of movement of the valve bracket 112 (FIG. 3) is adjustable. For this purpose, the upper end wall 159 of the spring holder 158 is arranged to contact an internally threaded adjusting nut 172 which is threaded onto an externally threaded stem 174 that is a part of and depends from the bracket 110. A depending pointer bar 176 on the bracket 110 carries a set screw 178 which is arranged to contact the adjusting nut 172 and lock it in place. The exterior surface of the adjusting nut is provided with indicia 171 which are correlated to the pointed lower end of the pointer bar 176 so that the volumetric capacity of the valve can be predetermined and set by scale.

OPERATING CAMS

The operation of the various cams for manipulating the valve components are briefly summarized with reference to FIGS. 1–6. The cylinder C (FIG. 4) is inserted into a container K for the filling operation by the cylinder hold-down cam 78 (FIG. 3) which, reading counterclockwise in FIG. 1, has an angular extent of from 270° to 135°. The hold-down cam 78 (FIG. 3) forces the cylinder actuating roller 76 downward as previously described thus moving the entire outer framework of the valve assembly downward and inserting the cylinder C into the can K. The cylinder C is retracted upward by the cylinder cam 74 (FIG. 3) which extends continuously around the turret T (FIG. 1). The measuring piston P (FIG. 4) and the plug valve PV are raised and lowered by the actuating roller 72 being elevated by the piston cam 70 and lowered by the cylinder cam 74.

The plug valve PV (FIG. 4) is independently movable up and down relative to the measuring piston P by the cam roller 80 (FIG. 5), the plug valve closing cam 82, and the plug valve opening cam 84. As shown in FIG. 1, the plug valve closing cam 82 extends from 348° to 18°. The plug valve opening cam 84 extends from about 252° to 279°. Referring back to FIG. 4, the plug valve PV has a cylindrical lower end 180 which carries an O-ring 182 in a circumferential groove thereof. The measuring piston P (FIG. 4) has a cylindrical aperture 184 with which the O-ring 182 effects a fluid tight seal between the supply chamber 168 thereabove, and the measuring chamber MC below the plug valve and piston. The aperture between the plug valve PV and the lower end of the measuring piston P cooperatively define a charging port CP through which the carbonated beverage is supplied to the measuring chamber MC.

The opening cam 90 (FIGS. 1 and 2) for the foot valve FV (FIG. 4) has an angular extent of from 11° to 60° (FIG. 1) and reacts on the upper camming shoe 86 (FIG. 3). While the opening cam 90 pushes the camming shoe 86 downward, the lower camming shoe 88 rides atop a cooperating cam track 92 (FIG. 1) which has an angular extent of from 4° to 87°. In the manner previously described, when the camming shoe 86 (FIG. 5) is pivoted downward about the axis of the shaft 124, the fork 136 (FIG. 6) moves the cam rollers 134 across the diagonal cam tracks 132 in the cam track block 128. The cam track block 128 thus pushes downward on the foot valve actuating rod 126 (FIG. 4) to open the filling port FP between the measuring cylinder C and the foot valve FV. Thus, the foot valve is provided with a conical lower end having an axial cylindrical sealing surface 186 which is circumferentially grooved and carries an O ring 188. The O ring 188 (see FIG. 7A) cooperates with a cylindrical sealing surface 189 in the end wall 190 of the measuring cylinder C. To effect a sliding seal between the relatively movable cylinder C and piston P, the piston carries an external sealing ring 191.

Figure 7:
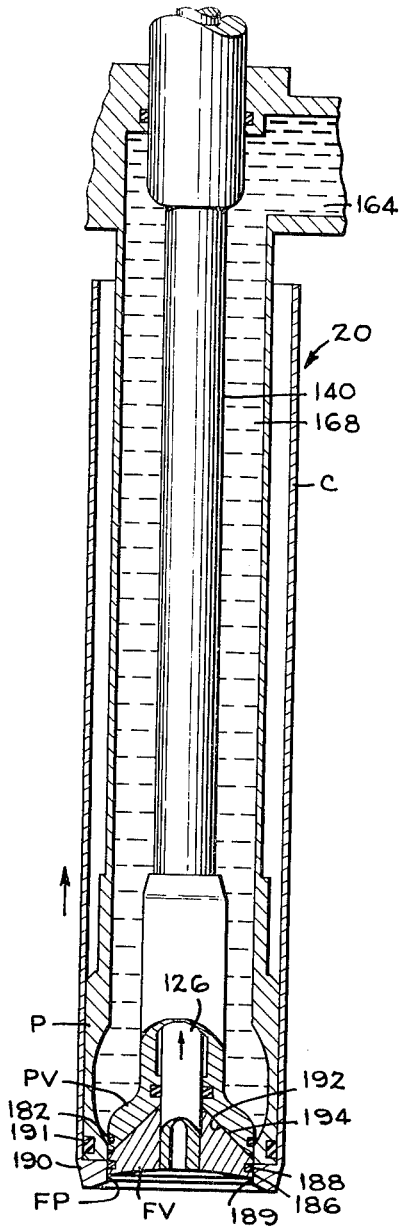
Figure 7A:
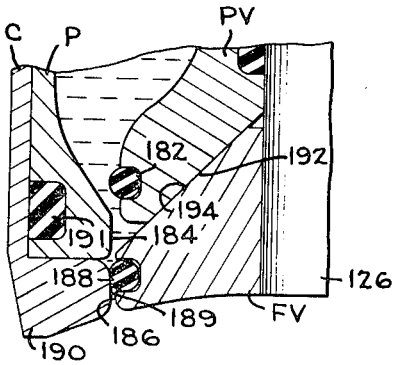

At this point it should be noted that the plug valve PV (FIG. 4) is provided with a conical recess 192 in its undersurface which is complementary to the conical upper surface 194 of the foot valve FV, and that during operation of the filling valve 20, these surfaces abut so that the foot valve and plug valve are nested together, as shown in FIG. 7, and their respective sealing rings 188 and 182 are adjacent. As presently described, during a filling cycle the plug valve PV is raised by the upward movement of the foot valve FV in order to prevent compressing any gas, air or liquid between the sealing rings 182 and 188.

The foot valve closing cam 92 (FIG. 2) which reacts against the lower camming shoe 88 extends angularly about the turret T (FIG. 1) from about 225° to 292°. When the camming shoe 88 (FIG. 5) is lifted by the foot valve closing cam 92, the fork 136 (FIG. 6) raises the rollers 134 to the position shown, thus elevating the cam track block 128 and lifting the foot valve FV (FIG. 4) to close the filling port FP.

OPERATION

The operational sequence shown in FIGS. 7–15 begins at FIG. 7, wherein the filling valve 20 has completed a filling operation and is ready for a new filling cycle. The angular position of the filling valve 20 of FIG. 7 is indicated on FIG. 1 at about 270° and the angular positions of FIGS. 8–15 are similarly indicated.

In the FIG. 7 position, the plug valve PV and the foot valve FV are nested together and the foot valve sealing ring 188 (FIG. 7A) is in sealing relation with the cylindrical seating surface 189 of the filling port in the measuring cylinder C. The supply chamber 168 and the inlet conduit 164 are full of the carbonated beverage supplied from the manifold tank 102 (FIG. 2). With reference to the enlarged view of FIG. 7A, it will be noted that the plug valve PV has been raised by the foot valve FV to lift the plug valve sealing ring 182 out of sealing engagement with the cylindrical seating surface 184 for the charging port of the measuring piston P. The positions of the valve sealing elements shown in FIG. 7A form an important aspect of the present invention, and are later referred to in this operational sequence.

Referring to the directional arrows on FIG. 7, it will be noted that both the foot valve FV and the cylinder C are rising, as is the plug valve PV, because the plug valve is being lifted by the foot valve FV.

Figure 8:
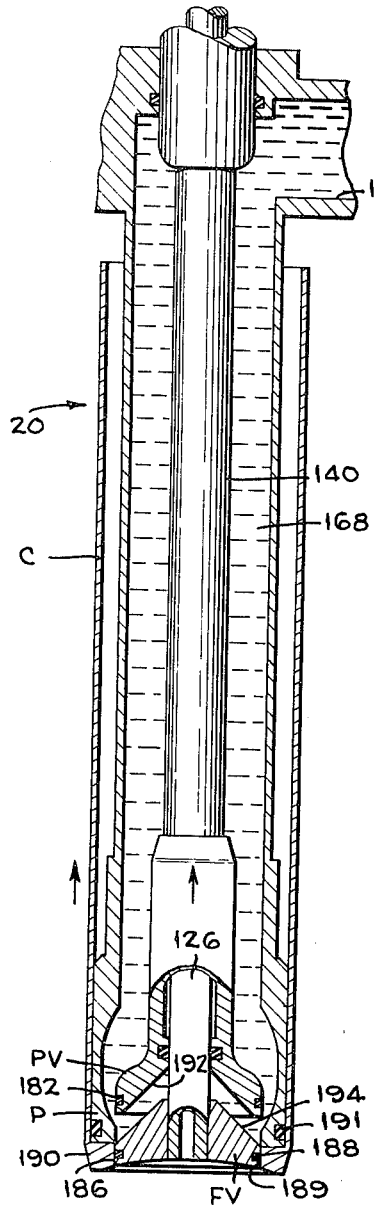

In FIG. 8, which is indicated at about 275° on FIG. 1, the foot valve FV and the cylinder C are rising together to provide clearance for an incoming container. The plug valve PV, however, is now being lifted more rapidly that the foot valve FV, in order to provide a larger passage between the plug valve and the piston during transfer of fluid from the supply chamber 168 (FIG. 7) to the measuring chamber MC (FIG. 9).

At about 290° (about 15° ahead of the FIG. 8 position) the cylinder C will reach its uppermost limit of movement. As previously mentioned, an empty incoming can K is fed through the turret T (FIG. 1) at 338.4°, and becomes vertically aligned beneath the filling valve 20 as shown in FIG. 2. Shortly before the can is thus aligned, (starting at 330°) the cylinder C starts downward, and at 355° (FIG. 9) the cylinder is about half way down into the can K. Meanwhile, the relative (open) position of the plug valve PV and the measuring piston P is maintained. As the cylinder is being lowered into the can, the piston and foot valve assembly (valve open) is raised, as can be seen by comparing FIG. 9 with FIG. 10. This action continues until the measuring chamber MC is fully enlarged. Since this chamber has a diameter that is smaller than that of the can K, the chamber must be longer than the height of the can. As the foot valve assembly thus separates from the plug valve assembly, liquid flows down from the supply chamber 168 into the expanding measuring chamber MC.

Figure 9:
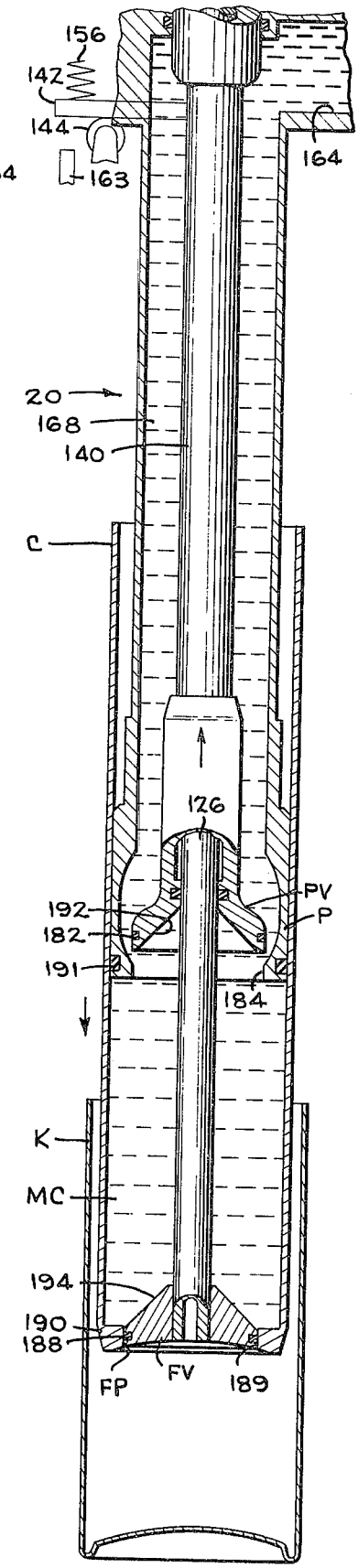

Illustrated at the top portion of FIG. 9, in schematic form, are the previously mentioned plug valve actuating elements, including the flange 142 on the plug valve (FIG. 6) the roller 144 pivotally supported by the piston, the stop lug 163 on the piston (FIG. 6) and the compression spring 156, between the piston and the plug valve. Referring to FIG. 9, the plug valve PV has been opened by pivoting of the roller 144. This prevents the spring 156 from closing the plug valve because the flange 142 is held up, clear of the stop 163 on the piston. As will be seen, later in the cycle, the roller 144 is pivoted down until it rests on the stop lug 163, whereby the spring 156 can lower the plug valve until its flange 142 seats on the roller 144. The plug valve is now closed (see FIG. 10).

Figure 10:
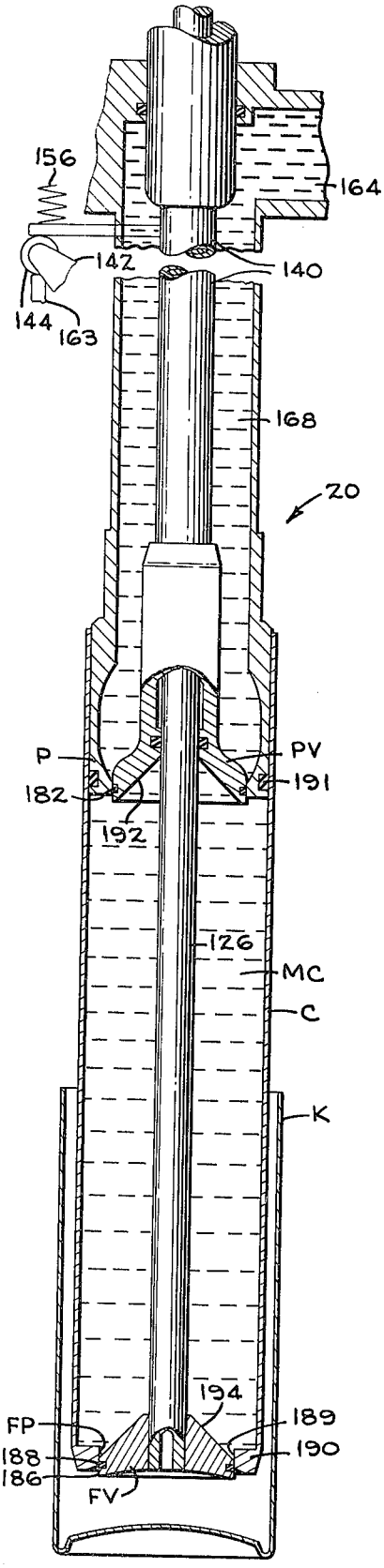

In FIG. 10 (at 20° on the turret T) the cylinder C has completed its descent into the can and the piston and plug valve are fully raised and closed, thereby determining the charge in the measuring chamber. As just described, the roller 144 has been pivoted down against the stop 163 and the spring 156 has completely closed the plug valve. Thus, between the FIG. 9 and FIG. 10 positions, the measuring piston P and the plug valve PV were raised to their uppermost positions by the cam 70 (FIG. 3) and as indicated by the arrows in FIG. 10 they are about to be simultaneously lowered.

Actually a significant step in the operation takes place just before the plug valve PV is fully closed, as shown in FIG. 10. When the plug valve was fully open, the roller 144 had been swung to its upper position and was latched there, as shown in FIGS. 3 and 9. When the roller 144 is unlatched by the cam 82 action on the roller 80 (FIGS. 5 and 6) the spring 156 starts to close the plug valve. As soon as the seal 182 on the plug valve makes sealing engagement with the cylindrical seating surface 184 of the charging port of the piston, liquid is trapped and compressed in the measuring chamber, a hydraulic block is thus established and without more, the plug valve PV could not be fully closed.

In order to completely close and seal the plug valve PV, and as indicated by the arrow at the foot valve FV in FIG. 10, the foot valve FV is lowered by its operating mechanism. As the foot valve FV is thus lowered, the aforesaid hydraulic block is progressively removed. The spring 156 now causes the plug valve PV to "follow" the foot valve and this action continues until the latter is fully seated in the piston. At this time, descent of the plug valve is stopped by the stop 163, the roller 144 and the flange 142, as shown in FIG. 10. An accurately measured charge of liquid, at a controlled and predetermined pressure, is now in the measuring chamber.

Upon completion of the stage just described, a second action takes place, namely reduction of the pressure in the measuring chamber MC substantially down to atmospheric pressure. This is readily accomplished by lowering the foot valve FV by a small additional amount, which increases the volume of the measuring chamber correspondingly, for achieving the aforesaid pressure reduction. The piston-like nature of the plug and foot valves facilitate the two stage operation just described. Thus the liquid in the supply chamber 168 has been isolated from the liquid in the measuring chamber MC and the filling charge in the measuring chamber has been accurately measured and has been reduced to atmospheric pressure by the described cooperative downward movement of the plug valve PV and the foot valve FV.

Figure 11:
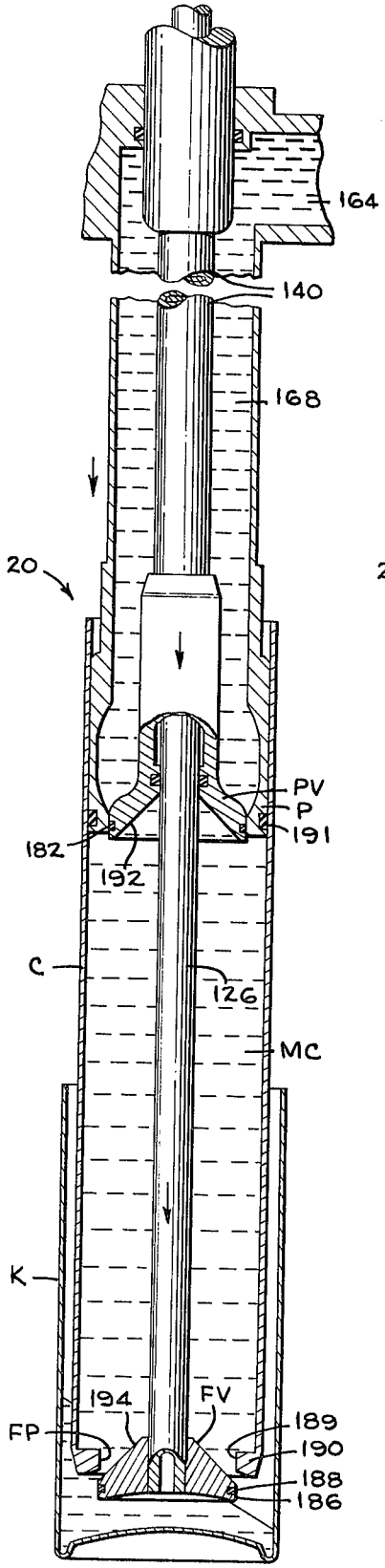

In FIG. 11 the cylinder C is in the same, fully lowered position as that shown in FIG. 10, but the foot valve FV has been independently lowered to its open position. Liquid now flows from the measuring chamber MC into the can K. The FIG. 11 position occurs at about 35° on the turret T (FIG. 1). It will be noted that the plug valve PV and the measuring piston P, with its charging port closed by the plug valve PV, are now moving down together through the cylinder C and are hence displacing liquid from the measuring chamber MC into the can.

Figure 12:
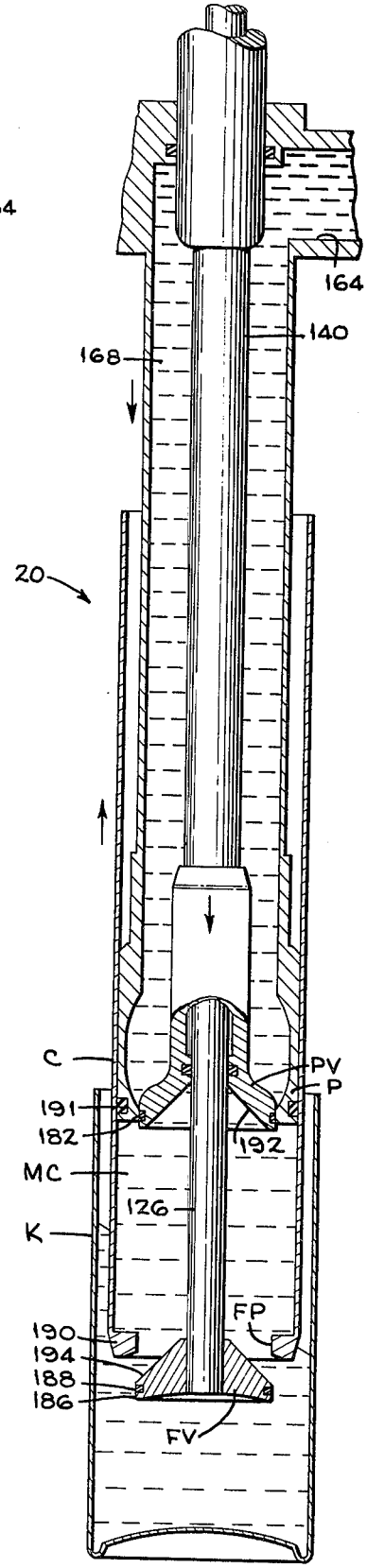

As seen in FIG. 12, shortly after the condition shown in FIG. 11, both the measuring cylinder C and the foot valve are being raised. However, the foot valve FV is opened still further, relative to the cylinder C. Since the relative velocity between the cylinder and foot valve assembly (rising together) and the piston and plug valve assembly (being lowered together) is now relatively high, the aforesaid additional opening of the foot valve facilitates displacement of liquid from the measuring chamber without turbulence.

It will be noted in FIGS. 11 and 12 that the upper surface of the fluid in the can K is inclined. This is caused by the action of centrifugal force resulting from can motion with the rapidly revolving turret. Thus, as shown in FIG. 13, the can track of the filler (not shown) is banked. This tilts the can K and prevents spillage over its outer lip. The aforesaid banking is carried out by means, not shown, which are known in the art, and the details of which are not critical to the present invention.

In FIG. 13 (at 245°) the can K has been completely filled, the piston P has bottomed out against the lower wall 190 of the cylinder and the filling valve 20 is being withdrawn from the can. The foot valve FV is still open, but it is about to be raised relative to the cylinder C so as to close off the filling port FP.

In FIG. 14, the foot valve FV has been lifted into engagement with the plug valve PV and these parts are in the nested relation wherein the upper surface 194 (FIG. 4) of the foot valve is in abutting contact with the lower surface 192 of the plug valve. Thus all gas and liquid have been excluded from between the aforesaid surfaces.

FIG. 14A is an enlarged view showing the conditions of FIG. 14. Although the plug valve sealing ring 182 is sealed against the cylindrical seating surface 184 of the piston P, the foot valve sealing ring 188 is not yet sealed against the cylindrical seating surface 189 of the cylinder C. Accordingly, the interstices between the upper and lower sealing rings 182 and 188 are open to atmosphere. Thus when the foot valve was lifted into abutting relation with the plug valve, as described, any gas or liquid between the valves was expelled to the atmosphere.

The filled can K (FIG. 15) is now being erected toward a more vertical position. FIG. 15 illustrates the position at about 265° on the turret T (FIG. 1) or just before the filled can is ejected from the filling machine.

As seen in the enlarged view of FIG. 15A, which shows the conditions of FIG. 15, the foot valve FV has been lifted to bring its sealing ring 188 into initial sealing engagement with the cylindrical seating surface 189 of the filling port in the cylinder C. The aforesaid closing of the foot valve FV lifted the foot valve FV correspondingly, but because of the piston-like nature of the valves, the upper sealing ring 182 of the plug valve PV merely slides along the cylindrical charging port surface 184 of the piston P and the plug valve remains in sealing engagement with that surface. Although gas is now trapped between the seals 182, 188, such gas is trapped at atmospheric pressure. The entire filling valve 20 is now being elevated as a unit clear of the can K.

As the filling valve is returned from the position of FIG. 15 to the start position shown in FIG. 7, the foot valve FV is raised by slight additional amount. This is best seen by comparing the enlarged views, FIG. 15A and FIG. 7A. The aforesaid raising of the foot valve FV lifts the plug valve PV correspondingly, and the sealing ring 182 of the plug valve PV is lifted out of sealing engagement with the piston P. However, the sealing ring 188 of foot valve FV merely slides along the cylindrical seating surface 189 and remains in sealing contact with the filler port of the cylinder C. Since the gas which was trapped between the upppr and lower sealing rings 182 and 188 (FIG. 15A) was at atmospheric pressure, the unseating of the plug valve with the piston (FIG. 7A) introduces no pressure change into the supply chamber 168, and the trapped gas is readily displaced by the inflow of liquid without causing foaming.

In an actual commercial embodiment of the present invention, 60 of the filling valves 20 are mounted on the turret T (FIG. 1), and the output in 12 ounce containers is in the order of 1,500 cans per minute. In addition to the balanced fluid flow through the filling valves, decompression of the filling charges, and prevention of trapping and compressing air or liquid between the sealing surfaces, a further valuable feature of the described structure is that the sealing surfaces are self aligning because of their cylindrical form and because of the long bearing surfaces provided by the actuating rod 126 and the plug valve shank 140.

Although the best mode contemplated for carrying out the present invention has been herein shown and described, it will be apparent that modification and variation may be made without departing from what is regarded to be the subject matter of the invention.

What I claim is:

1. A filler for filling open top containers with liquid from a reservoir; said filler including a valve connected to the reservoir and having elements comprising a cylinder, a foot valve, a piston and a plug valve; means for establishing communication between said cylinder and a container; said cylinder having a bottom wall formed with a container filling port, closeable by said foot valve; said measuring piston being slidable in said cylinder and having a bottom wall formed with a charging port closeable by said plug valve; said piston and plug valve elements having bottom wall surfaces respectively conforming to the opposed surface of the bottom wall of said cylinder to the opposed surface of said foot valve and means for independently operating said elements to trap a measured quantity of liquid in a measuring chamber defined by said elements, followed by opening of said foot valve and displacement of the liquid from said measuring chamber to a container; the improvement wherein said filling port and said foot valve have cooperating seating surfaces with one of said surfaces being cylindrical and with sealing means at the other seating surface, said charging port and said plug valve also having cooperating seating surfaces with one of said seating surfaces being cylindrical and with sealing means at the other seating surface, said seating surfaces being concentric, said operating means first raising said foot valve from an open position and into engagement with said plug valve while the latter is sealed with said piston charging port, said operating means then raising the valves until said foot valve seals off the filling port in said cylinder, said operating means continuing to raise said valves until said plug valve breaks the seal with said piston charging port while maintaining the seal between the foot valve and the cylinder filling port.

2. The filler of claim 1, wherein said plug valve is raised by lifting said foot valve.

3. The filler of claim 1, wherein said filling port and said charging port seating surfaces are the cylindrical seating surfaces.

4. The filler of claim 1, wherein said cylindrical seating surfaces are of the same diameter.

5. A filler for filling open top containers with carbonated liquid from a reservoir; said filler comprising a valve connected to the reservoir and having elements comprising a cylindrical, a foot valve, a piston and a plug valve, means for establishing communication between said cylinder and a container, said cylinder having a bottom wall formed with a container filling port closeable by said foot valve; said measuring piston being slidable in said cylinder and having a bottom wall formed with a charging port closeable by said plug valve; means for independently operating said elements to trap a quantity of liquid in a chamber defined by said elements, said operating means thereupon increasing the volume of said chamber slightly to reduce the pressure therein, said operating means then opening said foot valve and causing displacement of the liquid from said measuring chamber to a container; the improvement wherein said filling port and said foot valve have cooperating seating surfaces with one of said seating surfaces being cylindrical and with sealing means at the other of said seating surfaces, said operating means comprising means for slightly lowering said foot valve relative to said cylinder, while maintaining the seal between said foot valve and the filling port, for effecting said increase in the volume of said chamber.

6. The filler of claim 5, wherein the filling port seating surface is the cylindrical surface.

7. The filler of claim 5, wherein said charging port and said plug valve have cooperating seating surfaces with one of said surfaces being cylindrical and with sealing means at the other of said seating surfaces, stop means for determining the lowermost position of said plug valve, said operating means comprising spring means for lowering said plug valve against a quantity of liquid trapped in said chamber, said operating means thereupon lowering said foot valve with said plug valve following the foot valve until the plug valve engages said stop means, said operating means then additionally lowering said foot valve for effecting said volume increase in the chamber.

8. The method of filling open top containers with liquid from a reservoir by employing valve elements connected to the reservoir and including a cylinder and a cooperating foot valve, and a piston and a cooperating plug valve in said cylinder, which elements have seals and can be operated to fill a measuring chamber with liquid, followed by opening of the foot valve and collapsing of the measuring chamber for filling; the improvement comprising the steps of raising the foot valve against the plug valve to exclude gas from between the valves while the plug valve is sealed with the piston and while the foot valve is open, so that the space between the seals is open to atmosphere; and raising the two valves to seal the foot valve with the cylinder while the plug valve remains sealed with the piston, thereby trapping gas at atmospheric pressure between the seals, continuing to raise the two valves to break the seal between the plug valve and the piston, thus causing liquid in the measuring chamber to flow down to the seal at the foot valve.

9. The method of claim 8, comprising the step of continuing to raise the two valves to break the seal between the plug valve and the piston, thus causing liquid in the measuring chamber to flow down to the seal at the foot valve.

10. The method of claim 9, comprising the steps of raising said foot valve and said plug valve simultaneously and at the same rate, to break the seal between the plug valve and the piston.

11. The method of claim 10, comprising the step of raising the plug valve by lifting it by means of the foot valve.

* * * * *

UNITED STATES PATENT OFFICE
CERTIFICATE OF CORRECTION

PATENT NO. : 3,949,791
DATED : April 13, 1976
INVENTOR(S) : LESLIE VADAS

It is certified that error appears in the above–identified patent and that said Letters Patent are hereby corrected as shown below:

Col. 3, line 45, before "valve" insert -- plug --.

Col. 5, line 20, before "rods" change "guided" to -- guide --.

Col. 12, line 64, change "cylindrical" to -- cylinder --.

Signed and Sealed this

Twentieth Day of July 1976

[SEAL]

*Attest:*

RUTH C. MASON
*Attesting Officer*

C. MARSHALL DANN
*Commissioner of Patents and Trademarks*